US005095826A

United States Patent [19]

Erisson et al.

[11] Patent Number: 5,095,826

[45] Date of Patent: Mar. 17, 1992

[54] INCINERATOR

[75] Inventors: C. G. Folke Erisson, Upsala; Jens S. Bredal-Hansen, Huddinge, both of Sweden

[73] Assignee: Gavle Forsaljnings AB, Sweden

[21] Appl. No.: 576,507

[22] PCT Filed: May 4, 1989

[86] PCT No.: PCT/SE89/00178

§ 371 Date: Oct. 4, 1990

§ 102(e) Date: Oct. 4, 1990

[87] PCT Pub. No.: WO89/09912

PCT Pub. Date: Oct. 19, 1989

[30] Foreign Application Priority Data

Apr. 5, 1988 [SE] Sweden ..... 8801235

[51] Int. Cl.[5] ..... F23B 5/00

[52] U.S. Cl. ..... 110/212; 110/213; 110/214

[58] Field of Search ..... 110/210, 211, 212, 214, 110/213

[56] References Cited

U.S. PATENT DOCUMENTS

| | | | |
|---|---|---|---|
| 1,156,398 | 10/1915 | Fischer . | |
| 2,847,950 | 8/1958 | Naulin | 110/214 |
| 3,538,864 | 11/1970 | Segrest et al. | 110/3 |
| 4,321,878 | 3/1982 | Segrest | 110/212 |
| 4,334,484 | 6/1982 | Payne | 110/214 |
| 4,402,738 | 9/1983 | Akio | 110/213 |
| 4,483,256 | 11/1984 | Brasher | 110/214 |
| 4,509,435 | 4/1985 | Adams | 110/213 |
| 4,515,089 | 5/1985 | Ehrlichmann | 110/214 |
| 4,870,910 | 10/1989 | Wright et al. | 110/214 |

FOREIGN PATENT DOCUMENTS

| | | |
|---|---|---|
| 257576 | 6/1911 | Fed. Rep. of Germany . |
| 2523661 | 11/1976 | Fed. Rep. of Germany . |
| 2506250 | 8/1985 | Fed. Rep. of Germany . |
| 75525 | 8/1931 | Sweden . |
| 363886 | 2/1974 | Sweden . |
| 2180630 | 4/1987 | United Kingdom . |

*Primary Examiner*—Henry C. Yuen
*Attorney, Agent, or Firm*—Bacon & Thomas

[57] ABSTRACT

The invention relates to an incinerator apparatus, comprising a primary combustion chamber (12), means for heating the primary combustion chamber (12), a secondary combustion chamber (14) communicating with the primary combustion chamber (12), and afterburner means opening out into the secondary combustion chamber (14) and through which the combustion gases from the primary combustion chamber (12) are caused to pass when entering into the secondary combustion chamber (14). Between the primary combustion chamber (12) and said afterburner means there is arranged a mixing chamber 13 extending along one long side of the primary combustion chamber (12) and communicating therewith via a venting gap (23), adjustable in height and formed between the upper part (8) of the primary combustion chamber (12) and the upper edge of a partial partition wall (11), which separates the primary combustion chamber (12) from the mixing chamber (13). The secondary combustion chamber (14) includes a winding passage (14*b*, 14*c*) extending along substantially the whole bottom portion (9) of the primary combustion chamber (12) and in heat exchanging contact therewith.

17 Claims, 3 Drawing Sheets

INCINERATOR

BACKGROUND OF THE INVENTION

1. Field of the Invention

The present invention relates to an incinerator or cremation apparatus of the type which, apart from the combustion chamber proper, also has a secondary combustion chamber serviced by extra burner means for improved final combustion of the combustion gases.

2. Discussion of Prior Efforts in Field

A conventional incinerator included in a crematorium contains as a central part a combustion space for the coffin, heated with gas, oil or electricity, although most often by one or more oil burners. After the combustion space has been preheated to about 700° C., heating is broken off and the coffin is inserted. Air is subsequently supplied, and the coffin ignites by itself and burns together with its contents. During the process the temperature rises to about 1100° C. Excess secondary air is supplied to a post-combustion zone or chamber for final combustion of the combustion gases before they are led to a chimney. A modern variant of this incinerator type is described in SE-B-363 886, for example.

Such incinerators have several disadvantages, however, inter alia poor draught, largely due to the avoidance of large chimnies in crematoria for esthetic reasons. Since it is desired on ethical grounds to avoid actively supporting the combustion with an outside heat supply (e.g. oil burners), the result of combustion is often unsatisfactory due to the furnace temperature being too low at the beginning and end of the combustion process. This in turn leads to a fall in temperature in the post-combustion zone, causing incomplete final combustion with accompanying odour and smoke puffs through the chimney.

It has been attempted to put these disadvantages right in different developments of this conventional incinerator design. Accordingly, there are described, e.g. in U.S. Pat. No. 1,156,398, U.S. Pat. No. 3,538,864 and DE-C-257576 incinerators where a post-combustion chamber placed below the primary combustion chamber has been provided with a special afterburner, past which the combustion gases from the primary combustion chamber have to pass via one or more venting openings in the lower part of the primary chamber. There is indeed obtained improved chimney draught and better final combustion in these designs, but so the final combustion of the combustion gases will not be sufficiently effective for satisfactorily restricting or eliminating troublesome environmental poisons such as dioxines and nitrogen oxides. Due to the combustion gases being vented off in the lower part of the primary combustion chamber, there is also poor conversion of the combustion gases in the upper part of the combustion chamber, resulting in large fluctuations in composition of the combustion gases which come into the secondary combustion chamber and, as will be easily understood, this disadvantageously effects the final combustion. In addition, it is only in the design according to U.S. Pat. No. 3,538,864 that the heat in the post-combustion chamber is recovered to some extent for utilization in the primary combustion space.

BRIEF SUMMARY OF THE INVENTION

The object of the present invention is to provide an improved incinerator apparatus of the kind mentioned in the introduction, where extremely effective final combustion, fully sufficient for such as substantially completely eliminating dioxines and considerably reducing nitrogen oxide contents, is achieved at the same time as effective feedback of combustion heat from the post-combustion chamber to the primary combustion chamber.

The term incinerator is to be understood in a wide sense in the present context, and apart from combustion furnaces for crematoria also includes furnaces for similar use in hospitals, veterinary institutions, etc.

In accordance with the present invention the above objects are achieved with a modified, unsymmetrical incinerator structure, in which, on one hand, very homogeneous composition of the combustion gases taken to the post-combustion chamber is obtained by the gases being taken out from the primary combustion chamber through a specially shaped gap in its upper parts, and to a mixing arranged at the side of the combustion chamber, the combustion gases being thoroughly mixed in this mixing chamber before they are allowed to pass the burner or burners in the post-combustion chamber, and in which, on the other hand, increased and well-controlled residence time at high temperature in the secondary combustion chamber, and thereby uniform and effective feedback of heat to the primary combustion chamber is achieved by the secondary combustion chamber being disposed under the primary combustion chamber, and preferably also under the mixing chamber, as a winding passage in heat-exchanging contact with the bottom portions of these chambers. Further, in accordance with the invention, the above-mentioned gap is adjustable in height, and at least its upper edge is easily exchangeable. The combustion process can thus be optimized without affecting the draught regulating properties of the furnace.

Such an incinerator apparatus has the distinguishing features disclosed in claim 1. Advantageous embodiments of the invention are disclosed in the subclaims.

An essential property of the incinerator apparatus in accordance with the invention, and which is not present in previous furnace structures, is thus that all combustion gas is caused to pass along a single path through the same temperature and control profile, which ensures a uniform flue gas product.

BRIEF DESCRIPTION OF THE DRAWINGS

The invention will now be described in more detail with reference to a special, non-restricting embodiment, and with reference to the accompanying drawings, where.

DETAILED DESCRIPTION OF THE PREFERRED EMBODIMENT

Figure 1:
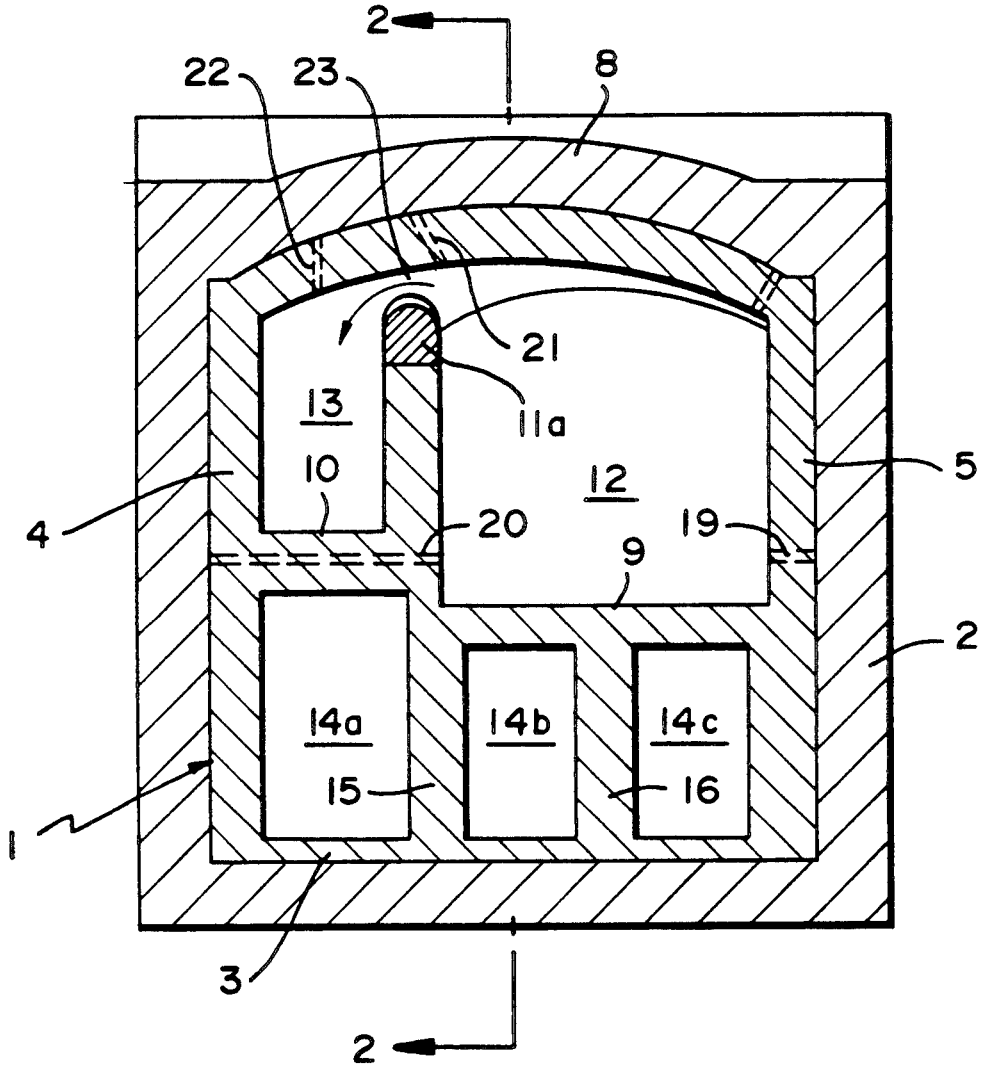
FIG. 1 is a vertical cross sectional view of an embodiment of an incinerator apparatus in accordance with the invention.

The incinerator illustrated in FIGS. 1-4, and intended for use in a crematorium, includes an inner furnace structure 1 made from highly refractory material covered by an outer layer 2 of at least heat resistant, heat-insulating material. The inner furnace structure 1 is mainly defined by a bottom portion 3, two long side walls 4, 5, two short end or side walls 6, 7 and a somewhat arched roof 8. The incinerator is divided into a primary combustion chamber 12, into which the coffin is to be inserted, a mixing chamber 13 and a secondary combustion chamber 14 by two horizontal partition walls 9 and 10 and a vertical partition wall 11, not fully extending vertically, which will be described in more detail below. The secondary combustion chamber 14 is divided into three parallel, interconnecting passage portions 14*a*, 14*b* and 14*c* by partition walls 15 and 16, which do not have full horizontal extension, and which will also be described in more detail below. A burner 17, e.g. an oil burner, is arranged in the short side wall 6 in the upper part of the primary combustion chamber 12, and in the illustrated case it is directed obliquely inwards-downwards in the combustion chamber. An insertion hatch 18 for the coffin is arranged in the opposing short side wall 7 in the primary combustion chamber 12.

Lower ducts for supplying primary air to the primary combustion chamber 12 are arranged in its long side walls 5 and 11 and are indicated by the reference numerals 19 and 20 respectively. Upper primary air ducts for the combustion chamber 12 are arranged in the roof 8 and indicated by the reference numeral 21. By reference numeral 22 optional ducts for supplying secondary air are indicated, these also being placed in the roof 8 but opening out into the mixing chamber 13.

The above-mentioned partial partition wall 11 has a variable upper part 11*a*, so that its height and profile, and thereby the size and shape of the gap 23 formed between the partition wall 11 and the roof 8 can be adjusted for each individual furnace to give optimum draught, and thus optimum venting of combustion gases from the primary combustion chamber 12 to the mixing chamber 13, simultaneously with minimization of thermal wear on the venting opening, which is a problem with today's furnaces. Accordingly, for example the main portion of the gas flow can be moved to a suitable place along the gap without affecting the draught regulating properties of the furnace. Such adjustability of the upper part 11*a* of the partition wall 11 can be achieved, e.g. by making it buildable in the form of suitably shaped "building bricks", e.g. ceramic blocks which can be placed one on top of the other and which are self-locking by means of tongue and groove means or the like. The whole of the partition wall portion separating the combustion chamber 12 and mixing chamber 13 may preferably be built up in this way such as to be readily removed and replaced, since this part of the combustion chamber is normally subjected to relatively large wear. Alternatively, the upper part of the partition wall 11 can be formed from a ceramic moulding composition, which enables a continuous, uniform and selectable gap profile.

In the forward part (i.e. to the left in FIG. 3) of the mixing chamber 13 there is an opening 24 made in the bottom portion 10 for communication with the forward passage portion 14*a* of the secondary combustion chamber. A burner means 25 is placed between the opening 24 and the passage portion 14*a* such as to open out in the portion 14*a*, the combustion gases from the mixing chamber being compelled to pass through the means 25 before they are taken into the first portion 14*a* of the combustion chamber.

Figure 5:
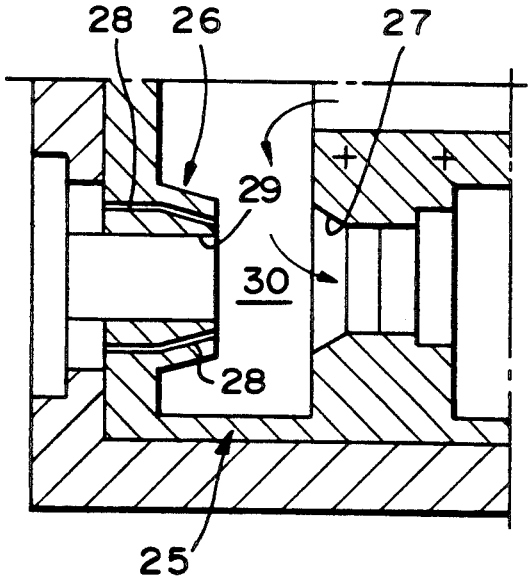
FIG. 5 is a vertical, partial cross sectional view along D—D in FIG. 4.

As it best seen from FIG. 5, the burner means 25 in the illustrated case is of the ejector type, and includes a jet burner 26 with high jet impulse arranged at some distance from a combustion product constricting and mixing nozzle 27 to provide a suction zone or space 30. Supply lines 28 for air or oxygen open out in a ring round the opening 29 of the jet burner 26. As will be seen in FIG. 5, the nozzle 27 has an advantageous stepped configuration, which inter alia reduces the gas resistance and ash deposits due to gas vortices. Since the bottom opening 24 in the mixing chamber 13 is in direct communication with the intermediate suction space 30 between the jet burner 26 and nozzle 27, and as mentioned above, all combustion gases leaving the mixing chamber 13 will be effectively sucked by ejector action through the burner means 25.

Figure 4:
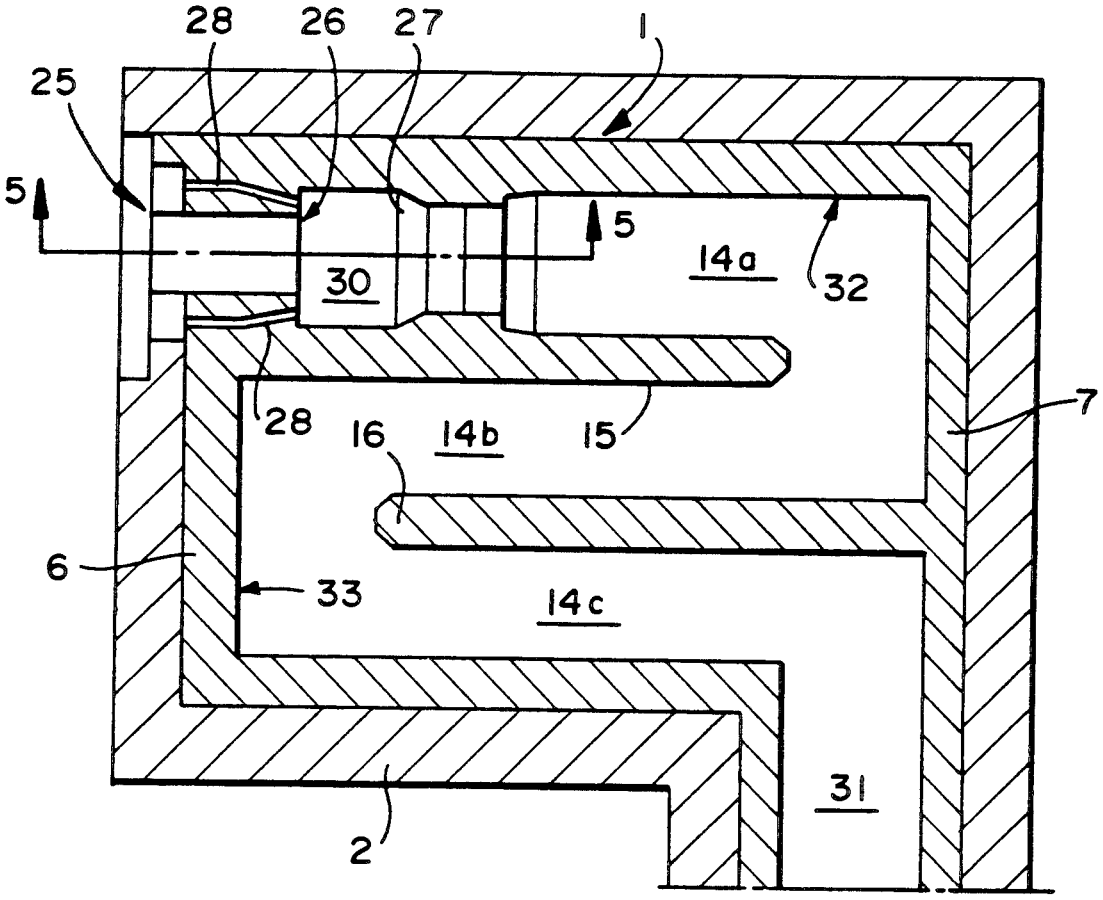
FIG. 4 is a horizontal cross sectional view along C—C in FIG. 2.

As will best be seen from FIG. 4, the secondary combustion chamber 14 takes up substantially the entire space under the primary combustion chamber 12 and mixing chamber 13. The secondary mixing chamber 14 is divided, by the previously mentioned partial partition walls 15 and 16, which project out from the short side wall 6 and from the opposing side wall 7, respectively, into a labyrinth-like passage comprising the three parallel passage portions 14*a*, 14*b* and 14*c*. The latter passage portion 14*c* terminates in a flue gas passage 31 connected to a chimney (not illustrated).

Operation of the burner means 25 can be controlled via at least one temperature sensor arranged in the secondary combustion chamber 14, preferably in its first portion 14*a*, and indicated by the reference numeral 32 in FIG. 4. In a similar way, the supply of extra air through the supply ducts 28 can be controlled by one or more sensors for the oxygen content, suitably arranged in the secondary combustion chamber 14 and indicated in FIG. 4 by the reference numeral 33.

Figure 2:
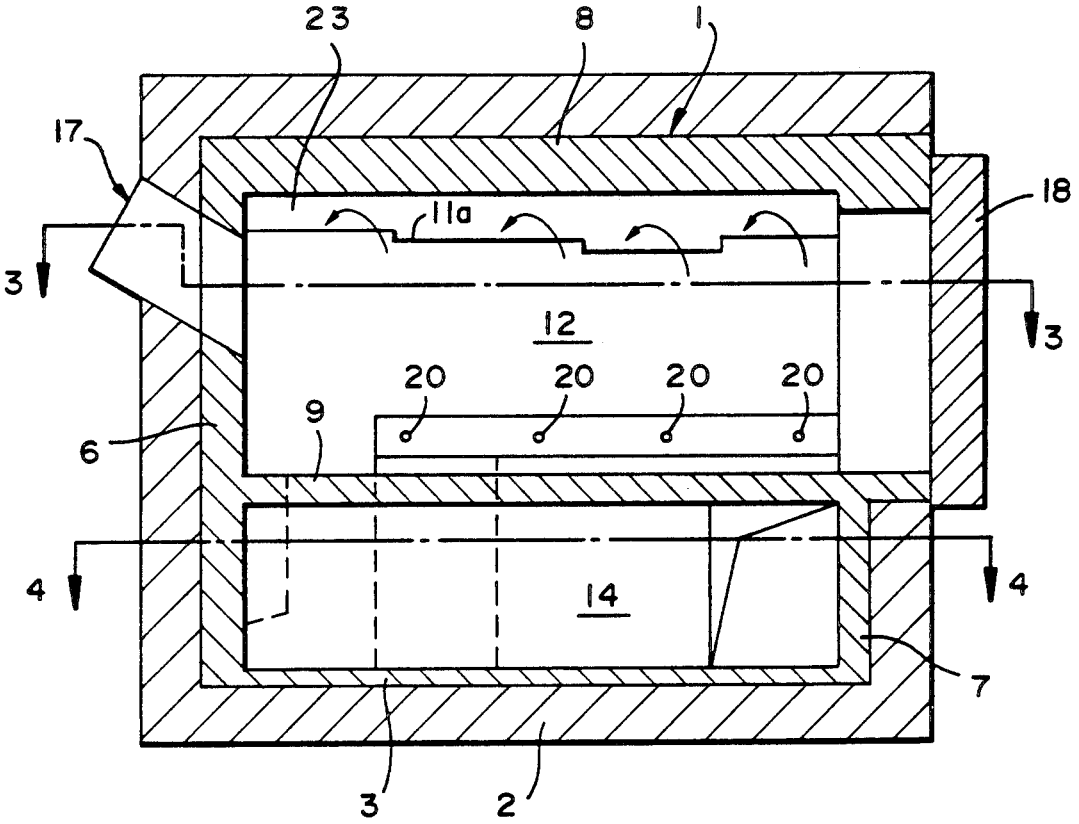
FIG. 2 is a vertical cross sectional view along A—A in FIG. 1.
Figure 3:
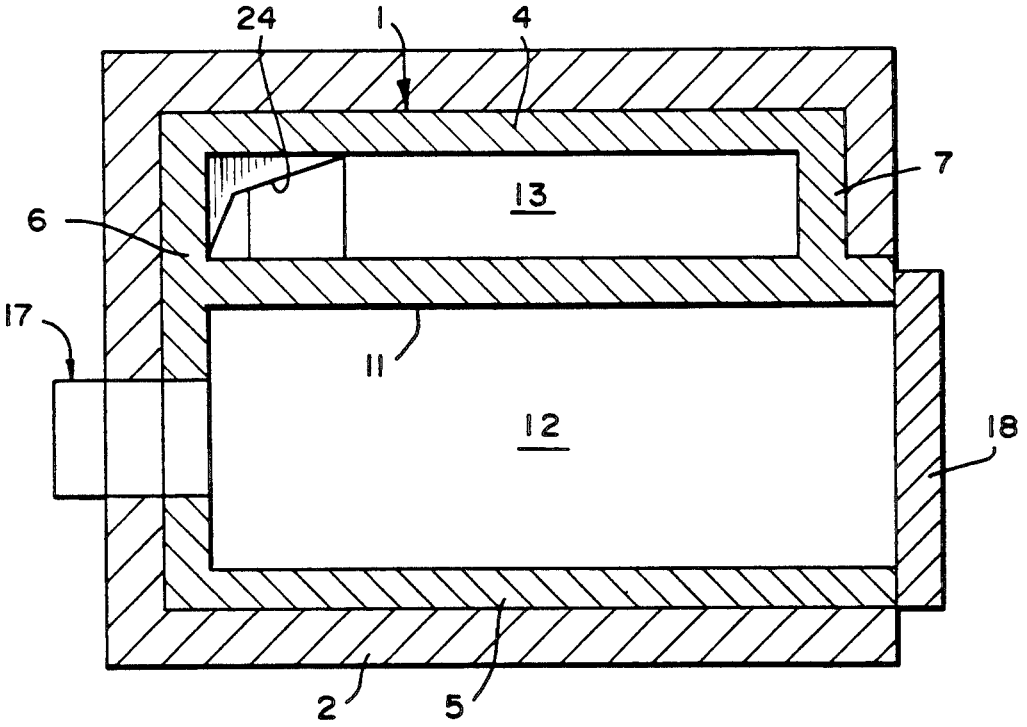
FIG. 3 is a horizontal cross sectional view along B—B in FIG. 2.

In using the incinerator apparatus illustrated in FIGS. 1-5, the primary combustion chamber 12 is first heated with the aid of the burner 17 to a suitable temperature, e.g. about 700° C. Heating is then broken off, and the coffin with the body which is to be cremated is inserted through the hatch 18, subsequent to which primary air is supplied via the air ducts 19-21. The inserted coffin then ignites by itself and is burned at a dampened controlled rate, the cremation of the body placed in the coffin then taking place. Combustion in the primary combustion chamber 12 takes place with a deficiency of air, so that the combustion process is given a pyrolytic character. The combustion gases formed, which are partially combustible, are sucked via the gap 23 between the partial partition wall 11 and the roof 8 to the mixing chamber 13. The adjustable upper part 11*a* of the partition wall 11 has of course been adjusted during running-in of the incinerator to give as good venting effect as possible by suitable adjustment of its height and profile. In this case it is assumed as an example that the stepped profile illustrated in FIG. 2 gives the best result.

Due to placing the venting gap 23 adjacent to the arched roof 8, good conversion of the combustion gases in the combustion chamber 12 is obtained without the formation of pockets of accumulated flue gases. Due to this greater fluctuations in the composition of the combustion gas reaching the mixing chamber 13 are avoided. In the mixing chamber 13 any concentration differences present in the combustion gas arriving at it have time to be well smoothed out before the gas is sucked out via the bottom opening 24 into the combustion means 25.

Effective post-combustion of the combustion gases takes place in the burner means 25 while supplying excess air via the supply ducts 28. As indicated earlier, this air excess can be optionally supplemented by secondary air via the ducts 22 in the upper part of the mixing chamber 13. The air supply and function of the burner means 25 are controlled by the oxygen and temperature sensors 32 and 33, respectively, arranged in the secondary combustion chamber 14 such as to give an as effective final combustion as possible.

Due to the labyrinth-like configuration of the secondary combustion chamber 14, the combustion gases have an extended and well-controlled residence time in it. Effective final combustion of the combustion gases can thus be ensured. For example, it has been found that a residence time of at least 0.8 seconds for the combustion gases at a temperature of at least 1000°-1100° C. is required for decomposition of dioxines and effective reduction of nitrogen oxides. This is achieved with no trouble using the described structure. The combustion gases which are taken to the chimney via the flue gas passage 31 are thus substantially fully combusted, and in particular they are free from dioxines and have heavily reduced contents of nitrogen oxides.

Due to the controlled residence time in the secondary combustion chamber 14 there is further obtained uniform temperature under the bottom portion 9 of the primary combustion chamber 12, the major part of the secondary combustion chamber 14 being placed under this portion, and in turn this arrangement provides an improved and shortened process cycle.

In using the above-described incinerator apparatus in such as a hospital or a veterinary institution, the combustion process will of course be more rapid by not having esthetic obstacles hindering continuous support of the combustion with the burner or burners 17.

The invention is of course not restricted to the embodiment specially described above and illustrated on the drawings, and many modifications and amendments can be made within the scope of the general inventive concept, as disclosed in the accompanying claims.

We claim:

1. In an incinerator including a primary combustion chamber, means for heating the primary combustion chamber, a secondary combustion chamber in communication with the primary combustion chamber and means associated with the secondary combustion chamber for afterburning gaseous combustion products discharged from the primary combustion chamber and into the secondary combustion chamber, the improvement comprising:

a mixing chamber disposed between the primary and secondary combustion chambers and arranged to receive all the gaseous combustion products from the primary combustion chamber and to discharge said combustion products into said secondary combustion chamber;

an upper roof extending in common over the primary and secondary combustion chambers;

a vertically extending partition wall separating the primary combustion chamber from the secondary combustion chamber along substantially one entire side of the primary combustion chamber, said partition wall being adjustable in height and extending from the lower area of said primary and secondary combustion chambers up to an area adjacent said roof, to thereby leave a variable height venting gap extending along one side of the primary combustion chamber between the upper end of said partition wall and said roof;

means for providing fluid communication between said mixing chamber and said secondary combustion chamber disposed at one end of the mixing chamber;

said secondary combustion chamber comprising a labyrinth passage extending beneath the primary combustion chamber and in heat exchange relationship therewith.

2. The improvement in an incinerator as claimed in claim 1 including regulatable means associated with said afterburner means for supplying air or oxygen to the afterburner means.

3. The improvement in an incinerator as claimed in claim 2, including an oxygen content-sensing means in said secondary combustion chamber and means for controlling said regulatable means for supplying air or oxygen responsive to oxygen sensed by said oxygen sensor.

4. The improvement in an incinerator as claimed in claim 3, including temperature sensing means in said secondary combustion chamber and means for controlling said afterburner means in response to temperature sensed by said temperature sensing means.

5. The improvement in an incinerator as claimed in claim 1, wherein said vertically extending partition wall has a varying height along its length.

6. The improvement in an incinerator as claimed in claim 1, wherein said afterburner means is an ejector-type burner including a jet burner, a suction zone downstream of the jet burner, and a mixing nozzle downstream of the suction zone, said jet burner, suction zone and nozzle disposed at one end of the secondary combustion chamber opposite the exit end thereof, said means for providing fluid communication between the mixing chamber and the secondary combustion chamber being in fluid communication with said suction zone.

7. The improvement in an incinerator as claimed in claim 6, wherein said means for providing fluid communication between said mixing chamber and said secondary combustion chamber comprises an opening in the bottom of the mixing chamber and a passage between the opening and said suction zone.

8. The improvement in an incinerator as claimed in claim 1, wherein said secondary combustion chamber includes horizontally spaced vertical side walls alternatingly extending from opposed end walls.

9. The improvement in an incinerator as claimed in claim 1, wherein said vertical partition wall is removable and replaceable.

10. The improvement in an incinerator as claimed in claim 1, including means for supplying secondary air in said mixing chamber.

11. The improvement in an incinerator as claimed in claim 6, wherein said mixing nozzle is a constriction to flow of gaseous combustion products between said mixing chamber and said secondary combustion chamber, and wherein said mixing nozzle has stepped side walls.

12. The improvement in an incinerator as claimed in claim 5, wherein said partition wall is stepped along its length.

13. The improvement in an incinerator as claimed in claim 1, wherein said primary combustion chamber, mixing chamber and secondary combustion chamber are all elongated with longer side walls than end walls; said vertical partition wall extends lengthwise of the primary combustion chamber and the mixing chamber; and said secondary combustion chamber labyrinth passage is arranged to direct combustion products in alternate directions extending lengthwise and widthwise of the primary combustion chamber.

14. The improvement in an incinerator as claimed in claim 1, wherein the upper part of said partition wall is formed from a ceramic moulding composition.

15. The improvement in an incinerator as claimed in claim 14, wherein said ceramic moulding composition varies in height along the length of the wall so that the venting gap is varied along the gap length.

16. The improvement in an incinerator as claimed in claim 7, wherein said suction zone is disposed beneath the terminus of said passage between the opening and said suction zone.

17. The improvement in an incinerator as claimed in claim 16, wherein a first portion of said secondary combustion chamber immediately downstream of said afterburner means extends beneath said mixing chamber.

* * * * *